United States Patent [19]

Narukawa

[11] Patent Number: 4,577,953

[45] Date of Patent: Mar. 25, 1986

[54] APPARATUS FOR DETECTING NORMAL/ABNORMAL MOUNTING OF BELT-LIKE PHOTOSENSITIVE MEMBER IN COPYING MACHINE

[75] Inventor: Atsushi Narukawa, Nara, Japan

[73] Assignee: Sharp Kabushiki Kaisha, Osaka, Japan

[21] Appl. No.: 684,738

[22] Filed: Dec. 21, 1984

[30] Foreign Application Priority Data

Dec. 24, 1983 [JP] Japan ..... 58-248341

[51] Int. Cl.[4] ..... G03G 15/00

[52] U.S. Cl. ..... 355/3 BE; 355/3 R; 355/16

[58] Field of Search ..... 355/16, 3 BE, 3 R, 14 R, 355/14 C, 14 CU; 198/807; 226/21; 474/102, 123

[56] References Cited

U.S. PATENT DOCUMENTS

| | | | |
|---|---|---|---|
| 4,095,887 | 6/1978 | Van Herten et al. | 355/3 BE |
| 4,110,033 | 8/1978 | Ophey | 355/3 BE X |
| 4,344,693 | 8/1982 | Hamaker | 355/3 BE |
| 4,429,985 | 2/1984 | Yokota | 355/16 X |
| 4,475,805 | 10/1984 | Omi | 355/3 BE X |
| 4,527,686 | 7/1985 | Satoh | 198/807 |

*Primary Examiner*—A. C. Prescott

*Attorney, Agent, or Firm*—Birch, Stewart, Kolasch & Birch

[57] ABSTRACT

A copying machine uses a belt-like photosensitive member installed between a pair of rollers from which the belt-like photosensitive member is freely detachable or mountable on these.

The preferred embodiments are capable of controlling the copying process timing using sensor means provided in the copying machine which detects either a plurality of cutout portions or markers on the lateral sides of the photosensitive member wherein the preferred embodiments comprise; a timer starting the counting operation when the photosensitive member diagnosis mode is entered simultaneous with the start of the roller rotation after turning the power of the copy machine ON; means for identifying whether the output signal from sensor means varies or not during a period when the timer counts a specific period of time; and means for alarming the operator that the photosensitive member is improperly installed onto rollers only when the output signal from sensor means remains unchanged within a specific period of time counted by the timer.

1 Claim, 4 Drawing Figures

APPARATUS FOR DETECTING NORMAL/ABNORMAL MOUNTING OF BELT-LIKE PHOTOSENSITIVE MEMBER IN COPYING MACHINE

BACKGROUND OF THE INVENTION

The present invention relates to a copying machine using freely mountable and detachable belt-like photosensitive member set between a pair of rollers, more particularly, to a device for identifying the mounted condition of the belt-like photosensitive member.

Conventionally, there are a variety of copying machines using belt-like photosensitive members. When using such a unit externally replacing the photosensitive members, since the mounting operation is manually performed, operator may start to operate the copying machine either by forgetting that the photosensitive member is not yet mounted or while the member is improperly set in position. If the copying operation is activated while the photosensitive member is absent or remains in improperly set condition, the copying machine will be adversely affected. In particular, if the photosensitive member is improperly mounted, the member cannot correctly rotate following the roller, thus jamming may occur to cause the member to be accidentally damaged.

OBJECT AND SUMMARY OF THE INVENTION

In the light of such disadvantages this described, the present invention aims at providing a useful device that easily identifies whether the belt-like photosensitive member has been correctly mounted or not by merely applying an output from the copy process timing control sensor without using any special sensors or switches. The present invention was motivated by a fact that if a sensor output remains unchanged for a specific period of time, then it can be identified that the photosensitive member is improperly mounted in such a copying machine using sensor means provided in the machine for detecting either a plurality of cutout portions or markers set in the lateral part of the belt-like photosensitive member when performing the copy process timing control. In other words, the preferred embodiment of the present invention comprises a timer that starts counting operation when the photosensitive member degnosis mode is entered by rotating the roller after the power of the copying machine turns ON; means for identifying whether the output from sensor means varies or not while the timer counts a specific period of time; and means for alarming that the photosensitive member is improperly installed in position when the output from sensor means remains unchanged for a specific period of time.

The preferred embodiment of the present invention correctly identifies properly or improperly installed photosensitive member by using an output from sensors controlling the copy process timing, and therefore, it doesn't need any sensor or switch means for detecting the mounted condition of the photosensitive member, thus making it possible to simplify the configuration of the mechanism and significantly reduce cost.

DETAILED DESCRIPTION OF THE PREFERRED EMBODIMENTS

Figure 1A:
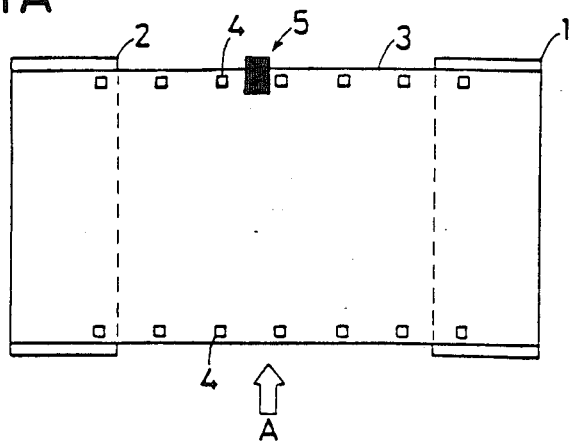
FIG. 1 is the belt-like photosensitive member and sensor means of a copying machine reflecting the preferred embodiment of the present invention, in which, (A) and (B) respectively show the plain and front views.
Figure 1B:
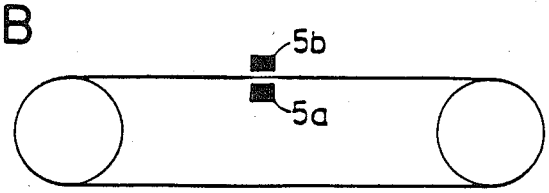

Referring now to the attached drawings, the preferred embodiments of the present invention are described below. FIG. 1 shows the belt-like photosensitive member and sensor means of a copying machine incorporating the preferred embodiment of the present invention, in which FIGS. 1(A) and (B) respectively show the plain and front views. Reference numbers 1 and 2 respectively indicate the drive roller and subordinate roller installed in the copying machine (not shown). The drive roller 1 is driven by a motor when either the print button is pressed ON or when the self-diagnosis mode is activated after the belt-like photosensitive member 3 is installed onto rollers 1 and 2 from the arrowed direction A. There are two cutout portions 4 on both lateral sides of the belt-like photosensitive member 3 for controlling the copying process timing at specific intervals. Provision of the cutout portions 4 on both lateral sides of the photosensitive member 3 allows the control operation to be properly done even when reversing the direction of installation of the photosensitive member 3 between roller 1 and 2.

Figure 2:
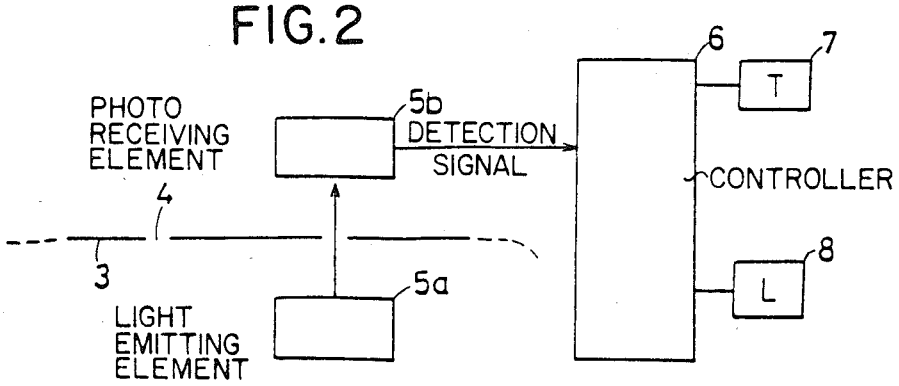
FIG. 2 is the simplified block diagram of the control circuit.

The copying machine is provided with photoelectric sensor 5 comprising a light emitting element 5*a* and light receiving element 5*b* capable of detecting the cutout portion 4 located in the upper lateral surface of the belt-like photosensitive member 3 installed between rollers 1 and 2. The photoelectric sensor 5 activates itself only when light from the light emitting element 5*a* has been received by the light receiving element 5*b*, which otherwise remains off. As a result, the output of the photosensitive sensor 5 repeats ON/OFF operations at specific intervals while the belt-like photosensitive member 3 keeps rotating between rollers 1 and 2. The output signal from the photoelectric sensor 5 is first led to the controller 6 as shown in FIG. 2. The controller 6 controls the ON/OFF timing of the main charger, transfer charger, and the static discharger activator (not shown) provided in the periphery of the belt-like photosensitive member 3 while the copying operation is underway in order to properly control each process related to the static charging, exposure, development, transfer, and the static discharge operations. Also, as described later on, the controller 6 correctly identifies in the self-diagnosis mode whether the belt-like photosensitive member 3 has been properly installed between rollers 1 and 2 on receipt of an output signal from the photoelectric sensor 5. Timer 7 connected to the controller facilitates the controller's operation for identifying the actual condition of the photosensitive member 5 between rollers 1 and 2. Lamp 8 externally warns the operator of the incorrectly installed condition of the photosensitive member 5 when the controller 6 has identified this.

Figure 3:
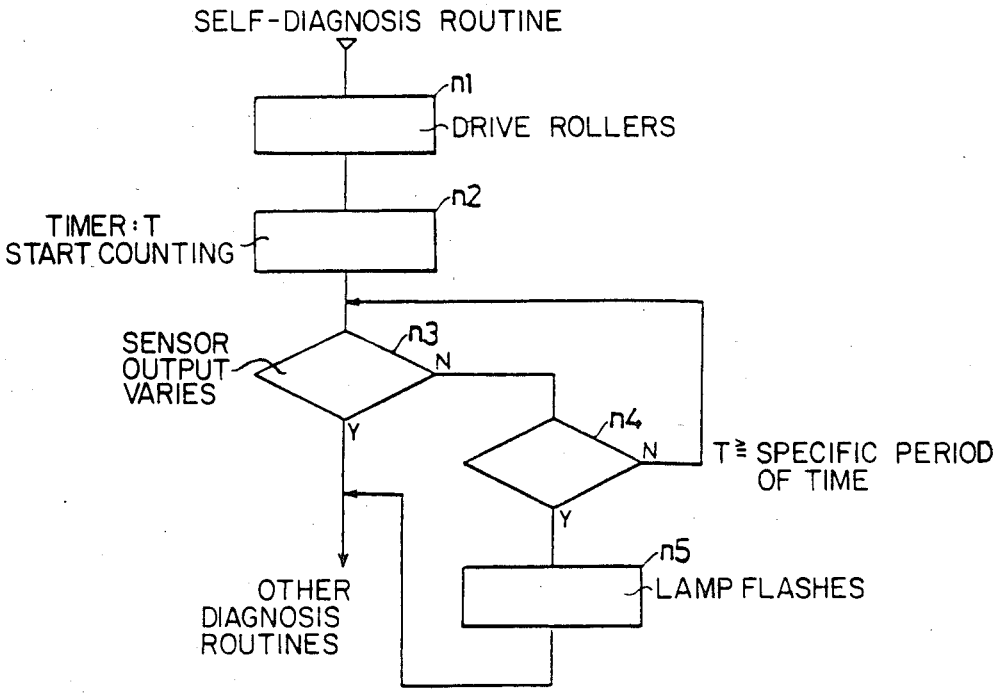
FIG. 3 is the flowchart describing the self-diagnosis routine related to the photosensitive member.

Next, in reference to FIG. 3, procedure for identifying whether the photosensitive member 5 has been properly installed between rollers 1 and 2 of a copying machine incorporating the above mechanism is described below. FIG. 3 shows the flowchart related to the self-diagnosis of the photosensitive member 3 to be executed when the photosensitive member 3 has been installed between rollers 1 and 2. First, as soon as the belt-like photosensitive member 3 has been installed between rollers 1 and 2 from the arrowed direction A (see FIG. 1), the controller 6 automatically enters into the photosensitive member diagnosis mode which is the first of all the self-diagnosis modes, and then proceeds to step n1. Step n1 causes the roller 1 to be activated. When the roller 1 is driven, the belt-like photosensitive member 3 starts to rotate between rollers 1 and 2. Next, step n2 causes the timer 7 to start counting time. While the activated timer counts a specific period of time during steps n3 and n4, the controller 6 then detects if the output signal from the photoelectric sensor 5 turns from ON to OFF or vice versa. If the belt-like photosensitive member 3 is not yet mounted, the output signal from the sensor 5 remains ON. Conversely, if the photosensitive member 3 is still provided with a protection paper, since the protection paper conceals the cutout portion 4, the output signal from the sensor 5 remains OFF. Likewise, if the photosensitive member 3 is mounted in such a position too far in the arrowed direction A, light from the light emitting element 5*a* remains being shut off by the photosensitive member 3, and as a result, the output signal from the sensor 5 remains OFF. Consequently, if the output signal from the sensor 5 still remains unchanged within a specific period of time after the timer 7 has started its counting operation, the controller can correctly identify that the photosensitive member 3 has been installed improperly even when the photosensitive member 3 has already been installed or not yet been installed in position.

Step n5 is executed by flashing lamp 8 only when the output signal from the sensor still remains unchanged within a specific period of time after the timer has started its counting operation. Step n4 may last its execution time only for a period of several seconds, and the timer 7 may be comprised of a software timer. Either such a lamp lighting up when replacing the photosensitive member or a lamp digitally indicating the number of the copied paper may be made available for lamp 8 so that any special lamp for displaying abnormal mounting of the photosensitive member 3 may be deleted. In the preferred embodiment described above, the photosensitive member diagnosis is executed during the self-diagnosis mode. Instead, another preferred embodiment makes it possible to activate the photosensitive member diagnosis immediately before entiring into the execution of the printing process by pressing the print-button. In addition, the present invention can effectively be applied to such a copying machine using a belt-like photosensitive member provided with specific markers in place of the cutout portion 4 to allow the sensor 5 to optically and electromagnetically detect markers 5. As is clear from the foregoing description, the preferred embodiment of the present invention easily and yet securely identifies either the satisfactory or improperly installed condition of the belt-like photosensitive member without providing any particular sensors or switches and correctly warns the operator of the improperly installed state of the photosensitive member upon detection of such an abnormal condition present inside the copying machine.

What is claimed is:

1. An apparatus for automatically identifying either the satisfactory or improperly installed condition of a belt-like photosensitive member in such a copying machine provided with a belt-like photosensitive member freely mountable and detachable between a pair of rollers and also with either a plurality of cutout portions or markers on the lateral sides of the belt-like photosensitive member detectable by sensor means incorporated in the copy machine wherein the identifying apparatus comprises;

. a timer starting the counting operation when the photosensitive member diagnosis mode is entered simultaneous with the start of the roller rotation after turning the power of the copy machine ON;

means for identifying whether the output signal from sensor means varies or not during a period when the timer counts a specific period of timer; and means for alarming the operator that the photosensitive member is improperly installed onto rollers only when the output signal from sensor means remains unchanged within a specific period of time counted by the timer.

* * * * *